US007245251B2

(12) United States Patent
Vogel et al.

(10) Patent No.: US 7,245,251 B2
(45) Date of Patent: Jul. 17, 2007

(54) APPARATUS FOR AUTOMATICALLY POINTING A DEVICE AT A TARGET

(75) Inventors: David A. Vogel, Westwood, MA (US); Erik W. Johnson, Norwell, MA (US); Richard L. McCulley, Weymouth, MA (US)

(73) Assignee: TSX Products Corporation, Norwood, MA (US)

( * ) Notice: Subject to any disclaimer, the term of this patent is extended or adjusted under 35 U.S.C. 154(b) by 120 days.

(21) Appl. No.: 10/971,320

(22) Filed: Oct. 22, 2004

(65) Prior Publication Data

US 2005/0149255 A1 Jul. 7, 2005

Related U.S. Application Data

(60) Provisional application No. 60/513,813, filed on Oct. 23, 2003.

(51) Int. Cl.
*G01S 13/00* (2006.01)

(52) U.S. Cl. ..... 342/61

(58) Field of Classification Search ..... 362/276, 362/234; 342/61

See application file for complete search history.

(56) References Cited

U.S. PATENT DOCUMENTS

| | | | | |
|---|---|---|---|---|
| 3,979,649 | A | 9/1976 | Persha | 318/17 |
| 5,282,589 | A | 2/1994 | Branigan et al. | 1/20 |
| 5,315,296 | A | 5/1994 | Kaiser et al. | |
| 5,490,046 | A | 2/1996 | Gohl et al. | 21/30 |
| 5,580,148 | A | 12/1996 | Liao | 1/24 |
| 5,589,901 | A | 12/1996 | Means | |
| 5,617,762 | A * | 4/1997 | Kirsch | 348/143 |
| 5,673,989 | A | 10/1997 | Gohl et al. | 21/30 |
| 6,191,547 | B1 | 2/2001 | Fricke et al. | 7/20 |
| 6,215,519 | B1 | 4/2001 | Nayar et al. | 348/159 |
| 6,315,435 | B1 | 11/2001 | Hamilton et al. | |
| 6,563,636 | B1 | 5/2003 | Baun et al. | |
| 6,596,976 | B2 * | 7/2003 | Lin et al. | 342/61 |
| 6,650,360 | B1 * | 11/2003 | Osen | 342/451 |
| 2002/0080617 | A1 | 6/2002 | Niwa et al. | 362/465 |
| 2003/0086251 | A1 | 5/2003 | Hamilton et al. | 15/2 |
| 2004/0105264 | A1 * | 6/2004 | Spero | 362/276 |

OTHER PUBLICATIONS

Jabsco Product 63022; ITT Industries; Marine/Searchlights/Remote Controlled Searchlights; Internet Website, 2 pages; Oct. 21, 2001.

* cited by examiner

*Primary Examiner*—Ali Alavi
*Assistant Examiner*—William J Carter
(74) *Attorney, Agent, or Firm*—Ohlandt, Greeley, Ruggiero & Perle, L.L.P.

(57) ABSTRACT

A system for pointing a device at a given target has a sensor for sensing a number of positional information points of the target with the sensor relaying the positional information points to a controller. The controller is for computing a directional control information based on the relayed positional information points. The system also has an adjustment device for moving the device in a direction that bears a predetermined relationship to the target in response to the computed direction control information. The target moves and the sensor senses the positional information of the target and the sensor relays the positional information to the controller with the controller computing the directional control information to control the adjustment device. The adjustment device points the device at the target.

35 Claims, 2 Drawing Sheets

APPARATUS FOR AUTOMATICALLY POINTING A DEVICE AT A TARGET

CROSS REFERENCE TO RELATED APPLICATIONS

This application claims priority to U.S. Provisional Patent Application Ser. No. 60/513,813 filed on Oct. 23, 2003, which is herein incorporated by reference in its entirety.

BACKGROUND OF THE INVENTION

1. Field of the Invention

The present invention relates to an apparatus that automatically points a device in a direction toward a target. More particularly, the present invention relates to an apparatus that automatically senses a location of the target, and of the device to be pointed and based upon those locations moves a searchlight using an adjustment device in the direction toward the target.

2. Description of the Related Art

Technology exists for manual remote control for positioning a searchlight through mechanical, wired and wireless electrical means. Such known patents include U.S. Pat. No. 3,979,649 to Persha, U.S. Pat. No. 5,490,046 to Gohl, et al., U.S. Pat. No. 5,673,989 to Gohl, et al., and U.S. Pat. No. 6,315,435 to Hamilton, et al. Hamilton discloses a controller that can be set in one of several positions relative to a heading of the searchlight platform. Another device sold under the name of Jabsco under Product 63022-0012. Jabsco discloses a searchlight that can be manually directed by a user, then set to sweep back and forth to illuminate a path of about 20 degrees wide.

The devices described by the above references are deficient in their operation. All such devices have a searchlight that maintains or sweeps a light beam's position in a heading that is fixed relative to a heading of a searchlight platform. However, this is not helpful in the art as very few applications for searchlights involve platforms that are fixed in position. Instead such platforms are dynamic and move.

Additionally, targets may be moving in relation to a fixed or mobile searchlight platform. Searchlight controllers of the prior art can only position the beam on the target briefly under these conditions and require constant manual adjustment from the user. This is time consuming and distracts the user from other important tasks.

Accordingly, there is a need for a system for pointing a device in a direction toward a target that eliminates one or more of the aforementioned drawbacks and deficiencies of the prior art.

SUMMARY OF THE INVENTION

It is an object of the present invention to provide an apparatus that points a number of types of devices at a number of types of targets.

It is another object of the present invention to provide a device like a searchlight that stays centered on a target and sweeps along a predetermined pattern.

It is still yet another object of the present invention to provide a system that can direct a device like a searchlight and can maintain a direction for the device to keep the device fixed on a target.

It is also an object of the present invention to provide a system that can point a device at a number of pre-selected targets in a predetermined order, or random order or can sweep between targets in the predetermined or random order.

It is yet another object of the present invention to provide a system that has a sensor that monitors a position of a target and controls a direction of the pointed device on a platform to keep the pointed device fixed on the target.

It is still yet another object of the present invention to provide a system that continuously calculates an estimated position of a target, and uses the estimate to automatically move the searchlight to point at the target.

It is still yet another object of the present invention to provide a searchlight that is connected to a global positioning service receiver that continuously calculates a position of a target, and relays the position information to a controller that automatically moves the searchlight to point at the target using an adjustment device.

It is a further object of the present invention to provide a controller that calculates a position of a target and controls an adjustment device to move a searchlight in response to the position of the target to maintain a beam emitted from the searchlight on the target.

It is an additional object of the present invention to provide a system that keeps the pointed device fixed on the target so that when the pointed device is activated it will automatically be fixed on the target.

It is still yet a further object of the present invention to provide a system that includes a microprocessor based controller that uses electronic position and attitude information to compute directional control information for an adjustable pointing device in order to point at a given target.

It is another object of the present invention to provide a controller that can be used with electronic positions from a global positioning source such as GPS or Loran, from a local positioning source such as radio, ultrasonic, or from infrared triangulation, or from pre-recorded electronic positions.

It is still another object of the present invention to provide a controller that uses position information of a target in either a latitude/longitude, Cartesian coordinates systems, or polar coordinate systems with or without elevation information.

It is still yet another object of the present invention to provide a controller that uses electronic bearing information from an electronic compass, a gyro, an inertial sensor, a multiple position sensor arrangement, or a pre-recorded electronic position information to determine the direction of the target relative to the pointed device.

It is a further object of the present invention to provide a controller that uses electronic bearing information with attitude information for pitch, and roll positioning of a pointing device platform.

It is a still a further object of the present invention to provide a pointing system with operator controls to manually control a pointing device and to control an operating mode of the system.

It is yet still a further object of the present invention to provide a pointing system with a manual pointer control that overrides automated control, chooses a target, corrects for error in pointer bearing, corrects for error in attitude, and/or target position.

It is another object of the present invention to provide a pointing system with a manual control having manual operating mode controls to set a sweep feature or a sweep amplitude control feature.

It is still another object of the present invention to provide a pointing system with a manual control with the manual controls being a joystick, a number of buttons, a number of switches, a mouse, a trackball, or any other input device.

These and other objects and advantages of the present invention are achieved by a system for pointing a device at a given target. The system has a sensor for sensing a plurality of positional information points of the target with the sensor relaying the positional information points to the controller. The system also has a controller for computing a directional control information based upon the relayed plurality of positional information points and has an adjustment device. The adjustment device is for moving the pointed device in a direction that bears a predetermined relationship to the target in response to the computed direction control information. The target moves and the sensor senses the change in the positional information. The sensor relays the plurality of positional information to the controller and the controller computes the directional control information to control the adjustment device. The adjustment device points the device at the target, and the device continuously points at the target as the target moves per unit time. The device moves in response to the movement by the adjustment device.

DETAILED DESCRIPTION OF THE INVENTION

Figure 1:
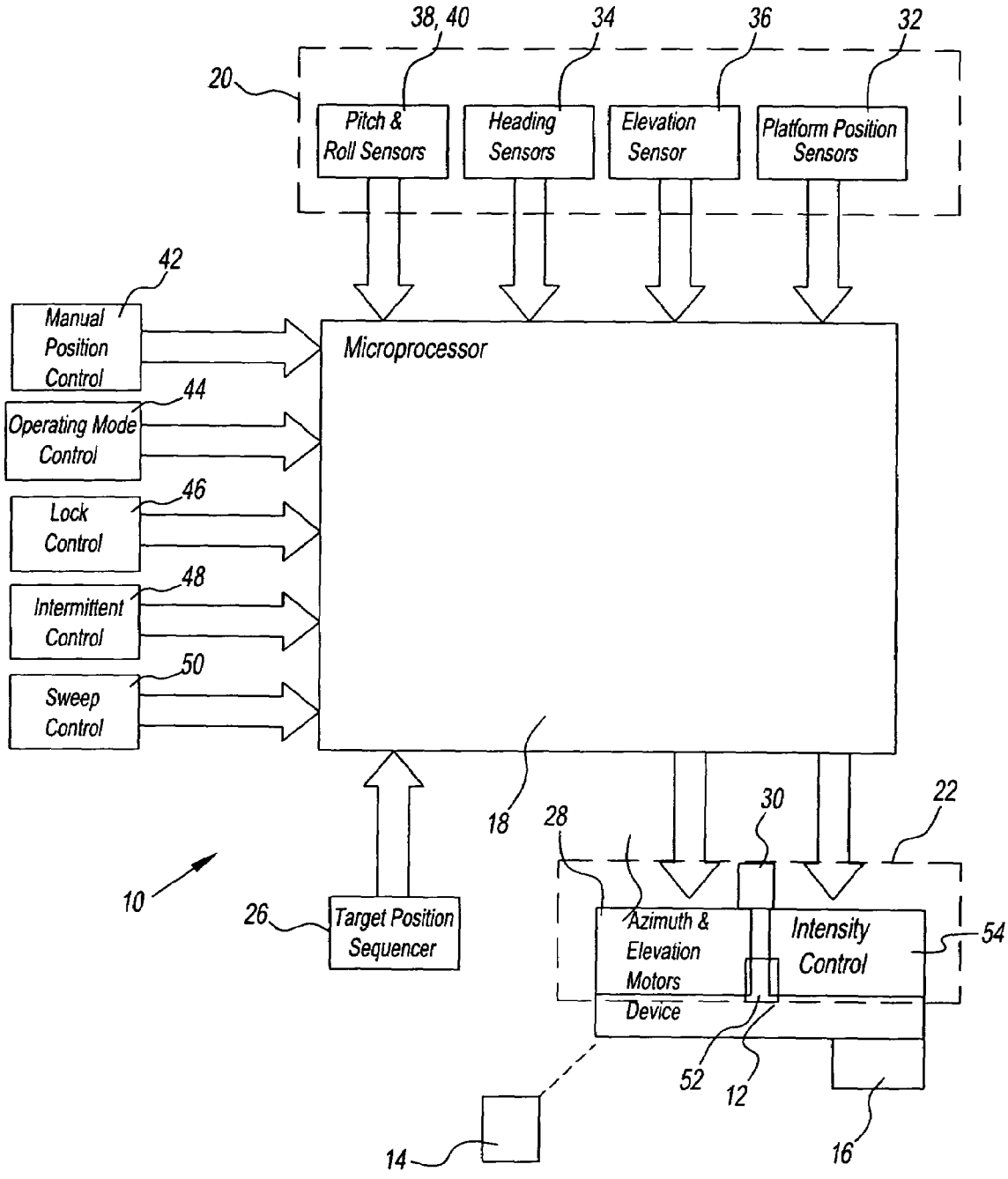
FIG. 1 is a schematic of the system of the present invention.

Referring to the Figures and, in particular, FIG. 1, the present invention is to provide a system 10. The system 10 can maintain a beam of a searchlight 12 fixed to a target 14 regardless of whether the target or a searchlight platform 16 connected to the system are mobile or stationary. Although, the system 10 is shown as being used with the searchlight 12, the system may be used with other electronic devices and in no way is limited to searchlights.

When activated, the present invention in one embodiment uses a controller 18 to read a latitude reading and a longitude reading of a searchlight's 12 position, and calculates positioning information. The present invention then automatically holds the searchlight 12 and positions the searchlight at a second or a next waypoint.

The searchlight 12 can then be switched off for extended periods to prevent light adaptation of a pilot and others on the water. When switched back on, the searchlight 12 will be positioned on the target 14 eliminating any manual searching by the pilot for the target. The beam of the searchlight 12 can also be swept from the searchlight platform 16 to the target 14 thus illuminating any obstacle that might be between a current position and a target position.

This illumination facilitates steering or otherwise controlling the vessel in a dark environment, prevents injury and thus eliminates much of the manual control of the searchlight 12, saves time, and assures safer passage to the target 14.

In another environment, a marine vessel entering an unfamiliar harbor after dark presents an application for a moving the searchlight 12 on the searchlight platform 16, with one or more stationary targets 14 of unknown or hidden positions. In this application, a marine vessel entering an unfamiliar harbor after dark manually controls the searchlight 12 to search for navigational buoys and obstructions. Once a target 14 is identified, the user presses the "lock" control. The controller 18 then calculates a "virtual waypoint" for the target 14 centered in the beam of the searchlight 12, and locks the positioning of the searchlight to maintain illumination of the target.

Once the target 14 is identified, the controller 18 is locked on the target. The controller 18 takes the instantaneous position and heading of the searchlight platform 16, and thus an instantaneous azimuth position and an elevation position of the searchlight 12. The controller 18 then computes a virtual way point. The virtual way point or calculated point is a point at a centermost location of a searchlight beam intersecting with a surface. The controller 18 maintains the position of the beam of the searchlight 12 on the target 14 regardless of a change of position or a heading of the searchlight platform 16, or the vessel connected to the searchlight platform.

Applications with stationary platforms 16 and stationary targets 14 are also enhanced with the features of the present invention. Applications exist with security lighting systems, and cameras.

An unlimited number of illumination targets 14 by way points could be stored in an external computer having the controller 18. When the way point information for the target 14 is transmitted to the controller 18, the controller would automatically direct the searchlight 12 to illuminate the target. For watchtower applications in which a number of security "hotspots" are to be monitored, the controller 18 could be programmed to sequence through illuminating each "hotspot" or target 14 in a programmed or random sequence.

Since the number of waypoints that could be used in this application is only limited by the storage of the external computer, vectors or pathways could be swept with the searchlight 12 to illuminate linear or more complex patterns. Applications for stationary searchlight platforms 16 with moving targets 14 also exist. One could envision a permanently mounted searchlight 12 on a pole or building. The user could carry a GPS position transmitting device or sensor 20. The data from the sensor 20 would be received by the controller 18. In this application, the target GPS or sensor 20 acts as an external way point sequencer by providing a stream of target position updates to the controller 18. The controller 18 would then keep the searchlight 12 pointed at the target 14 transmitting GPS as the target 14 moves within a range of a receiver.

One skilled in the art should appreciate that the system 10 is not limited to the device such as the searchlight 12, and may encompass other devices. The system 10 has a number of sensors 20 for sensing a number of positional informational points of the target 14 and/or the platform 16. The system 10 also has the controller 18, and an adjustment device 22 for moving the device 12 such as the searchlight in a direction that bears a predetermined relationship a direction of the target 14 think this needs to be distinguished further. One skilled in the art will appreciate that the system 10 of the present invention will function with a stationary device and a moving target, with a moving device and a stationary target where the system will sense a position of the device, and a position of the target is know, or a moving target and a moving device where the system senses both positions, or a fixed device and a fixed target(s).

In this embodiment, the device for pointing at the given target 14 is the searchlight 12. However, one skilled in the art should appreciate that the device is not in any way limited to searchlights and may be used with any electronic device known in the art such as a camera, a rescue device, a beacon, a camera, a recording device, an automobile application, a wireless internet application, a mobile phone, a tracking device, a transportation device, a building, an obstruction, an airline application or any other electronic device known in the art.

The adjustment device 22 preferably has a number of motors 24. The motors 24 control an azimuth of a beam emitted from the searchlight 12 and an elevation of a beam emitted from the searchlight. The searchlight 12 is preferably mounted to the searchlight platform 16. The platform 16 is a resilient structure preferably made from a resilient member such as steel or a thermoplastic, composite materials, aluminum, or any combinations thereof. The platform 16 could be mobile or stationary, such as part of a boat, an automobile, an aircraft, or a building. Pointer and platform positions are obtained from the number of sensors 20 such as a GPS device or an equivalent latitude/longitude navigational system. The term GPS means Global Positioning System and this term is considered well known in the art. The sensor 20 preferably received coded satellite signals processed by a receiver to compute position, altitude, velocity and time. The altitude of the platform 16 can be obtained from an electronic compass which provides pitch and roll data, or from orthogonally mounted inclinometers. Thereafter, the information provides an adjustment or pitch and a roll of the platform 16.

In one embodiment of the present invention, a target position of the target(s) 14 is pre-recorded and is obtained from a position sequencer 26. The position sequencer 26 provides position information at appropriate or predetermined time intervals to facilitate operation of the system 10.

Referring to the block diagram of the system 10 in FIG. 1, the system has the controller 18. Preferably, the controller 18 is a suitable microprocessor. The controller 18 preferably receives data from the various number of sensors 20 and/or user controls. The controller 18 then calculates a number of control signals required to direct the adjustment device 22 or more preferably the motors 24 that move the searchlight 12. The search light motors 24 are operatively connected to the searchlight 12 or device. The motors 24 move in response thereto and adjust the searchlight 12 to maintain the searchlight beam emitted from the searchlight on the desired target 14. In another exemplary embodiment of the present invention, the controller 18 controls an intensity of the searchlight beam at an appropriate time.

The entire system 10 with the exception of the target position sequencer 26 is preferably affixed to the mobile or the stationary platform 16. The target position sequencer 26 may be connected to the platform 16, may be remote from the platform, or may be absent depending on the application.

Preferably, the adjustment device 22 has a number of azimuth motors 28 and elevation motors 30. Also, the sensors 20 can be a platform position sensor 32, a searchlight heading sensor 34, a searchlight elevation sensor 36, and a pitch sensor 38 and a roll sensor 40. The adjustment device 22 and the number of sensors 20 are grouped together in the figure to indicate that they are all mechanically connected to the device or the searchlight 12.

The system 10 also has a manual light position control 42, an operating mode control 44, a lock control 46, an intermittent control 48, and a sweep control 50. These are all user interface controls that could be implemented as hardwired switches, as inputs from a computer interface, or as remote control inputs. One skilled in the art should appreciate that these controls are optional and the system 10 can be manufactured without such controls.

The controller 18 can be either an embedded microprocessor in a custom electronics solution, a commercially available microprocessor based controller, or a personal computer with sufficient input and output interfaces to communicate with the sensors 20 and adjustment device 22. The computations that guide the beam of the searchlight 12 are performed by a suitable software program having program instructions that is executed by the controller 18.

The searchlight 12 also can be of custom design or one that is commercially available. The searchlight 12 preferably has the adjustment device 22 connected thereto with a number of motor drives 52 that operatively connect the searchlight 12 to the motors 24 of the adjustment device 22. The number of motor drives 52 preferably move and/or direct the azimuth and the elevation of the search beam emitted from the searchlight 12. The searchlight 12 also has an intensity control 54 that controls the intensity of the light beam so that the search beam can be turned on, off, or dimmed.

The platform position sensor 32 is preferably a sensor that provides an electronic latitude and a longitude position data for the platform 16. The platform position sensor 32 is of sufficient resolution to control the searchlight 12 to the desired accuracy.

The platform position sensor 32 may be an embedded GPS receiver, or an external commercially available GPS receiver. Preferably, position data is not limited by GPS. Alternatively, LORAN or other navigational positioning system can be used based on the condition that a resolution of the data supplied is sufficient for the desired accuracy of the system 10.

For fixed platform controller applications, the platform position sensor 32 is not needed since the position of the platform 16 does not move. In fixed platform 16 applications, the platform position sensor 32 is replaced with a pre-programmed, fixed latitude and longitude or another coordinate system of the platform at a time of installation.

In one embodiment, the target position sequencer 26 can be implemented within the firmware of the controller/microprocessor 18 to supply target position coordinates to the controller. Alternatively, the target position sequencer 26 could be implemented by the way point sequencer of an external GPS, and external computer, or a position output of a GPS affixed to the target 14. The manner in which the coordinates are determined and the manner in which they are supplied to the controller 18 determine the systemic behavior of the controller.

The searchlight heading sensor 34 detects the horizontal direction (azimuth) of the searchlight 12. This searchlight heading sensor 34 can be implemented with an electronic compass mounted to the searchlight 12. In other embodiments, an electronic compass is mounted to the vessel, vehicle, or aircraft, and an encoder which senses the beam angle of the searchlight relative to the vessel heading is used to calculate the azimuth of the searchlight beam. In yet another embodiment, the searchlight heading sensor 34 is implemented with gyroscopes, inertial direction sensors, or any combination thereof.

The searchlight elevation sensor 36 detects the elevation angle of the beam angle of the searchlight 12 being above or below a horizontal. In controllers 18 that incorporate the optional pitch and roll sensors 38, 40, the pitch sensor can substitute for the elevation sensor 36 if the pitch sensor is mounted to the searchlight 12.

Figure 2:
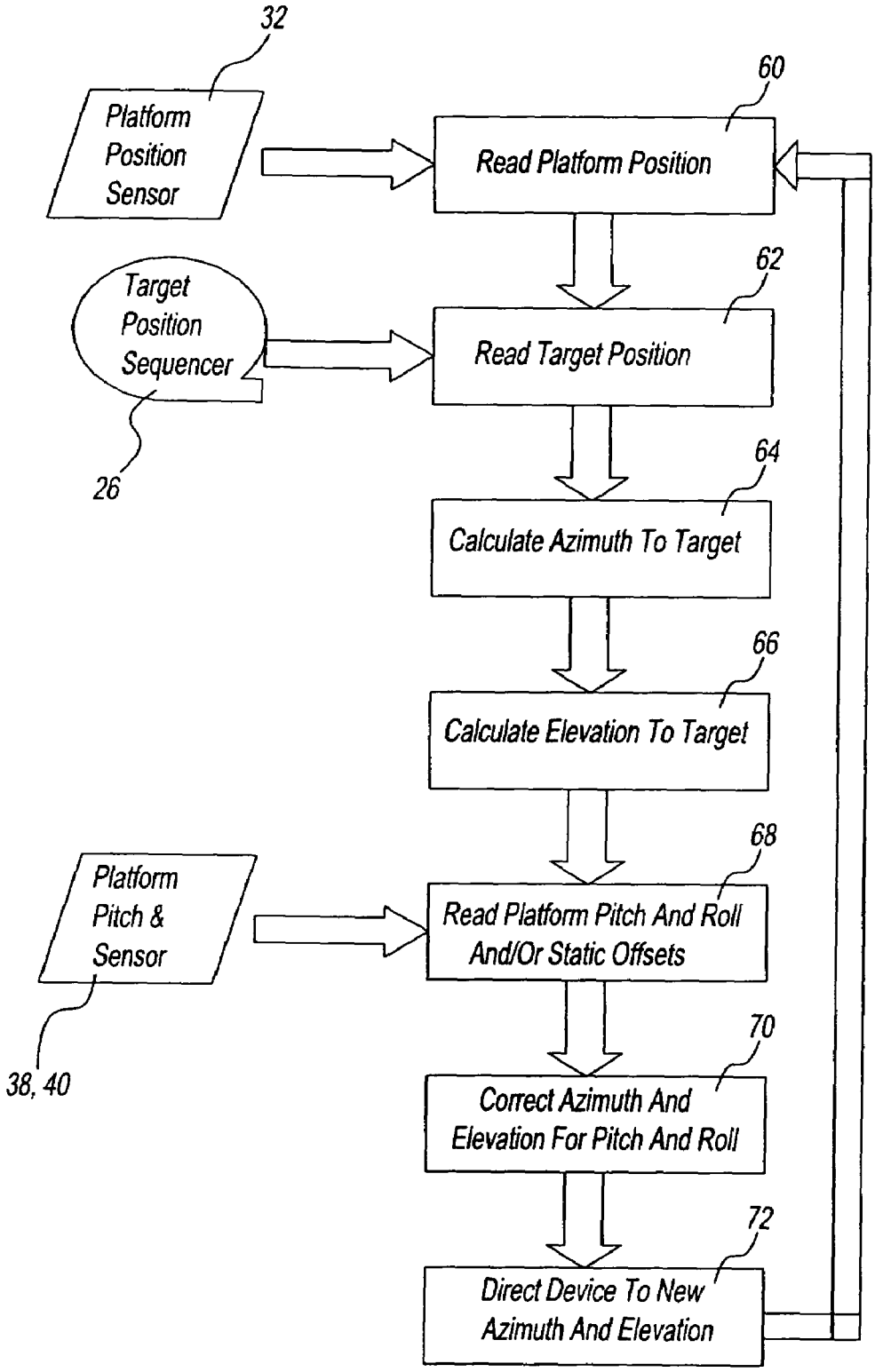
FIG. 2 is a schematic of a method of the system of FIG. 1.

Referring to the flowchart of FIG. 2, the beam is directed at the target 14 by the sequence of operations executed by the microprocessor 18. The differences in mode (automatic or manual) or in features (sweep or flash control) are handled by procedures outside this core computation. One skilled in the art should appreciate that the method may be electronically based as program instructions on a recordable medium such as a disk drive or another non-volatile memory.

At step 60, a platform's position, namely latitude and longitude in the case of a GPS position sensor, are read from the platform position sensor 32.

At step 62, the target's position, namely latitude and longitude, are read from the target position sequencer 26. The latitude/longitude position in units of degrees is converted to Cartesian coordinates in units of feet relative to the platform position. This conversion requires a determination of the number of feet per degree of latitude and longitude. These values change with latitude, so the latitude of the platform 16 in degrees ($Lat_p$) is used as an input to the following set of equations:

Feet Per Degree of Latitude:

$$F_{LAT}=364609.32-1836.68\cos(2\,Lat_p)+3.855\cos(4\,Lat_p)-0.00755\cos(6\,Lat_p)$$

Feet Per Degree of Longitude:

$$F_{LON}=365527.69\cos(Lat_p)-306.76\cos(3\,Lat_p)+0.387\cos(5\,Lat_p)$$

Given the feet per degree of latitude and longitude, the Cartesian coordinates of the target 14 (relative to the platform 16) are determined by the following equations:

Distance North (or South if Negative) of Platform:

$$X_T=(Lat_T-Lat_p)\times F_{LAT}$$

Distance East (or West if Negative) of Platform:

$$Y_T=(Lon_T-Lon_P)\times F_{LON}$$

where $Lat_T$ and $Lon_T$ are the latitude and longitude of the target respectively.

For the above equations, the signs of the latitude/longitude degree values are adjusted appropriately depending on which side of the Prime Meridian and/or Equator the platform and/or target are on.

The bearing to the waypoint is calculated from $$\text{arc tan}(X_T/Y_T),$$

adjusting by 90, 180, or 270 degrees depending on the X-Y quadrant. This result is then added in step 64 to the heading of the platform 16 which is the angle between the y-axis of the platform 16 and the waypoint to determine the azimuth ($Azi_L$) beam of the searchlight 12.

The elevation angle of the beam ($Ele_L$) is calculated by step 66 based on the known height ($H_L$) of the searchlight 12 above the surface of the earth, and the distance from the platform 16 to the target 14 from the following equation:

$$Ele_L=\arctan\left(\frac{\sqrt{X_T^2+Y_T^2}}{H_L}\right)-90.0$$

In applications where there is significant pitch and/or roll of the platform 16, whether from static offsets such as non-level platforms or from dynamic motion or otherwise an error, the azimuth and elevation are read by the sensor 20 at step 68 and can be corrected by step 70 applying transformations based on the pitch and roll angles. One skilled in the art will be able to understand such a transformation, as it is well known in the art.

Once the desired azimuth and elevation angles are known, step 72 directs the azimuth and elevation motors (3) to the new position required to fix the searchlight's 12 beam on the target 14. As soon as the motors 24 have been directed, the cycle is repeated starting at step 60. Step 70 can take the form of a number of embodiments. The motor controls 24 can be implemented in an open loop design using stepper motors, or pulsed operation of DC motors. Closed loop control designs are more precise, and can be implemented with feedback attitude sensors mounted directly to the searchlight 12. The system 10 may have a number of feedback sensors 20 that may be the same or different that the sensors recited above with heading sensors (not shown) and inclinometers (not shown), or rotational position encoders (not shown). The choice of implementation is one of preference, cost, and accuracy.

The manner in which the position of the target 14 coordinates are determined differs depending on the mode of the controller 18. In an "automatic" mode, the coordinates are selected from a recorded list of coordinates. In different applications, the list could be provided by route information provided by a commercially available GPS unit, from an external GPS unit affixed to the target 14, or from data entered by hand by the user or supplied by an external computer.

In the "manual mode" or "the point and lock" mode of operation, the user manually positions the searchlight beam 12 or other pointing device on the target 14 and presses the "lock" control. At that instant, the controller 18 calculates the coordinates of the target 12 by calculating at what coordinates the beam would intersect the surface of the earth based on the absolute azimuth and elevation of the beam. The equations used to calculate that coordinate are:

$$X_V=\frac{H_L}{\sin(-Ele_L)}\cos(Ele_L)\sin(Azi_L)$$

$$Y_V=\frac{H_L}{\sin(-Ele_L)}\cos(Ele_L)\cos(Azi_L)$$

That coordinate point is referred to as the "virtual waypoint" and is supplied to the target position sequencer 26 as target coordinates ($X_T$, $Y_T$) to allow the controller 18 to keep the searchlight beam 22 fixed on the virtual waypoint regardless of the motion of the platform 16.

As with the automatic sequence mode of operation, in applications where there is significant pitch and/or roll of the platform 16, whether from static offsets or dynamic motion, the calculated virtual waypoint can be corrected by applying the same transformations based on the pitch and roll angles.

The implementation of the target position sequencer 26 affects the overall operation of the controller 18 to control a mode between automatic and manual, or to sweep the searchlight beam 12 from platform 16 to target 14.

In an automatic mode, with a series of stationary targets 14 and a moving platform 16, the target position sequencer 26 selects the next waypoint target in a chained series of waypoint targets once the platform 16 has reached the current target 14.

In applications with a stationary platform 16 and a series of stationary targets 14 (such as a security searchlight 12 application) the target position sequencer 26 provides a circularly chained list of target coordinates to the controller 18 in predetermined timed intervals.

In applications with a moving target 14, and either a moving or stationary platform 16, the target carries at least one sensor 20. The sensor 20 may detect a position of the target 14 and transmits that data back to the target position sequencer 26. The target position sequencer 26 receives the target position data and supplies the positional information to the controller 18 allowing the system 10 to direct the searchlight beam 12 onto the target 14 as the target changes position.

In the case of a single target 14, such as a search and rescue operation, the target position sequencer 26 simply provides the coordinates of the single target 14. That target position could be manually supplied to the system, or could be supplied automatically by wireless communications from the target position sensor.

The sweep feature also is implemented with the target position sequencer 26. In this case, the target position sequencer 26 takes the position of the current target 14, and the current position of the platform 16. A number "n" of intermediate coordinates are calculated on a straight line from the platform 16 to the target 14. A temporary circularly chained list of target coordinates is created from the "n" intermediate coordinates and the target coordinates. The target position sequencer 26 cycles through the coordinates with timed delays between coordinates to illuminate a calculated path from the platform 16 to the target 14.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A system for pointing a device at a given target, the system comprising:

a sensor for sensing a plurality of positional information points of at least one of the target, the device, and a platform support for the device, said sensor relaying said plurality of positional information points to a controller, wherein the controller computes a directional control information based upon said relayed plurality of positional information points, and wherein said plurality of positional information points of the target comprises a latitude positional information point and a longitude positional information point; and an adjustment device for positioning the device in a computed direction that bears a predetermined relationship to the target in response to said computed direction control information, wherein the target moves relative to said pointed device, and said sensor senses said plurality of positional information points, said sensor relaying said plurality of positional information points to said controller, said controller computing said directional control information to control said adjustment device, wherein said adjustment device points the device at the target, and wherein the device continuously points at the target as the target moves relative to said pointed device per unit time, and moves in response to the movement by the adjustment device.

2. The system of claim 1, wherein the device is selected from the group consisting of a searchlight, a camera, a video camera, a digital recording device, an electronic device, a rescue device, a beacon, a recording device, an automobile application, a wireless internet application, a mobile phone, a tracking device, a transportation device, a building, an obstruction, an airline application, a computer, and any combinations thereof.

3. The system of claim 1, wherein said controller is a microprocessor.

4. The system of claim 1, wherein said sensor is selected from the group consisting of a platform position sensor, a heading sensor, an elevation sensor, a pitch sensor, a roll sensor, and any combinations thereof.

5. The system of claim 1, wherein said adjustment device comprises a motor, an elevation motor, an azimuth motor, and any combinations thereof.

6. The system of claim 5, wherein said motor is a plurality of motors.

7. The system of claim 6, wherein said plurality of motors comprises at least one azimuth motor and at least one elevation motor.

8. The system of claim 1, further comprising a target positioning sequencer connected between said sensor and said controller, said target positioning sequencer supplying said plurality of positional information points of the target from said sensor to said controller.

9. The system of claim 8, wherein said target positioning sequencer is integrated with said controller, and said controller is a microprocessor.

10. The system of claim 1, wherein said sensor comprises a plurality of sensors.

11. The system of claim 10, wherein said plurality of sensors comprise a device position sensor and a target position sensor.

12. The system of claim 11, wherein said device position sensor is a platform sensor for providing electronic latitude and electronic longitude of the device.

13. The system of claim 11, wherein said target position sensor detects a horizontal direction of the target.

14. The system of claim 11, wherein said target position sensor detects an elevation angle of the target.

15. The system of claim 10, wherein said plurality of sensors comprise a device position sensor, a horizontal target position sensor, and an elevation angle target sensor.

16. The system of claim 10, wherein said plurality of sensors have at least one pitch sensor.

17. The system of claim 10, wherein said plurality of sensors have at least one roll sensor.

18. The system of claim 1, wherein said controller locks a manually pointed device on the target.

19. The system of claim 1, further comprising a memory, and wherein said plurality of positional information points of the target are recorded on said memory.

20. The system of claim 1, wherein the device is stationary, and wherein the target moves.

21. The system of claim 1, wherein the target is stationary, and wherein the device moves.

22. The system of claim 1, wherein the target has said sensor thereon, and wherein said sensor transmits said plurality of positional information points of the target to a target position sequencer, said target position sequencer communicating said plurality of positional information points of the target to said controller.

23. An electronically controllable system for pointing a device at a given target, the system comprising:

a sensor for sensing a plurality of first positional information points of the target, said sensor relaying said plurality of first positional information points to a sequencer;

a controller for computing a first directional control information based upon said relayed plurality of first positional information points from said sequencer; and an adjustment device for moving said device in a first direction that bears a predetermined relationship to the target in response to said computed first direction control information, wherein said adjustment device moves said device to said first direction, wherein said sensor senses a second plurality of positional information points, said sensor relaying said second plurality of positional information points to said sequencer, said controller computing a second directional control information to control said adjustment device, wherein said adjustment device moves said device in said second direction that bears said predetermined relationship to the target in response to said computed second direction control information, and wherein said device continuously points at the target in response to a movement path of the target.

24. The system of claim 23, wherein the device is a movable light having a lamp wherein said controller controls an intensity of said lamp in response to a distance of the target from said movable light.

25. A method of moving a searchlight to shine on a target, the method comprising the steps of:

sensing a first position of the target;

communicating said first position of the target to a sequencer;

calculating a first direction to the target;

automatically moving the searchlight to point at said first location;

sensing a second position of the target;

communicating said second position of the target to said sequencer;

calculating a second direction to the target based on said second position, said second location being different from said first location, said different second location causing a first condition; and automatically moving said searchlight from pointing at said first location to pointing at said second location in response to said first condition, wherein the method is repeated for a plurality of locations of the target after said second location.

26. The method of claim 25, further comprising altering an intensity of the searchlight based on a calculated distance from the searchlight to the target, said intensity bearing a predetermined relationship to a timing cycle monitored by said controller.

27. The method of claim 25, further comprising the step of continuously moving said searchlight from pointing at said first location to pointing at said second location.

28. A system for pointing a device at a given target, the system comprising:

a first sensor for sensing a plurality of device positional information points, said first sensor relaying said plurality of device positional information points to a sequencer, said sequencer communicating said plurality of device positional information points to a controller;

a second sensor for sensing a plurality of target positional information points, said second sensor relaying said plurality of target positional information points to said sequencer, said sequencer for communicating said plurality of target positional information points to said controller, said controller for computing a directional control information of the target based upon said relayed plurality of device positional information points and said relayed plurality of target positional information points; and an adjustment device for moving the device in a plurality of directions in response to said computed direction control information, wherein said device moves in response to the movement by the adjustment device, and wherein the device continuously points at the target as the target moves per unit time.

29. The system of claim 28, wherein the device is a searchlight.

30. The system of claim 29, wherein said searchlight has an intensity, and wherein said controller controls said intensity based upon a distance between at least one of said plurality of device positional information points and at least one of said plurality of target positional information points.

31. A method of moving a searchlight to shine on a target, the method comprising the steps of:

sensing a first searchlight position of the searchlight;

sensing a second target position of the target;

calculating an azimuth location to the target;

calculating an elevation location to the target;

sensing a pitch parameter of the searchlight;

sensing a roll parameter of the searchlight;

sensing a static offset of the searchlight;

moving the searchlight in a first initial direction based on said pitch parameter, said roll parameter, and said static offset; and directing the searchlight to said azimuth location and said elevation location from said first initial direction, wherein the method is repeated for a plurality of positions of the target.

32. A system for pointing a searchlight at a given target, the system comprising:

a sensor for sensing a plurality of positional information points of at least one of the target, the searchlight, and a platform support for the searchlight, said sensor relaying said plurality of positional information points to a controller, wherein the controller computes a directional control information based upon said relayed plurality of positional information points, and wherein said plurality of positional information points of the target comprises a latitude positional information point and a longitude positional information point; and an adjustment device for positioning the searchlight in a direction that bears a predetermined relationship to the target in response to said computed direction control information, wherein the target moves relative to said pointed searchlight, and said sensor senses said plurality of positional information points, said sensor relaying said plurality of positional information points to said controller, said controller computing said directional control information to control said adjustment device, wherein said adjustment device points the searchlight at the target, and wherein the searchlight continuously points at the target as the target moves relative to said pointed searchlight per unit time, and moves in response to the movement by the adjustment device.

33. The system of claim 32, wherein the target is stationary and the searchlight moves.

34. The system of claim 32, wherein the target and the searchlight both move.

35. The system of claim 32, wherein the target and the searchlight are both stationary.

* * * * *